US005478547A

United States Patent [19]

Nagamura et al.

[11] Patent Number: 5,478,547

[45] Date of Patent: Dec. 26, 1995

[54] ULTRA-HIGH PURITY NITROGEN GENERATING METHOD

[75] Inventors: Takashi Nagamura; Takao Yamamoto; Shinji Tomita, all of Hyogo, Japan

[73] Assignee: L'Air Liquide, Societe Anonyme pour l'Etude et l'Exploitation des Procedes Georges Claude, Paris, France

[21] Appl. No.: 124,072

[22] Filed: Sep. 21, 1993

[30] Foreign Application Priority Data

Sep. 22, 1992 [JP] Japan ..... 4-276830

[51] Int. Cl.[6] ..... C01B 21/00

[52] U.S. Cl. ..... 423/351; 422/169

[58] Field of Search ..... 423/351

[56] References Cited

U.S. PATENT DOCUMENTS 5,238,670 8/1993 Louise et al. ..... 423/351

FOREIGN PATENT DOCUMENTS 0182620 5/1986 European Pat. Off. .
0485612 5/1992 European Pat. Off. .
0589766 3/1994 European Pat. Off. .
1241 1/1965 Japan ..... 423/351
183789 7/1990 Japan .
2-183789 7/1990 Japan .
5-079754 3/1993 Japan .

*Primary Examiner*—Wayne Langel
*Attorney, Agent, or Firm*—Young & Thompson

[57] ABSTRACT

An ultra-high purity nitrogen generating method comprises: feeding feed air to a carbon dioxide eliminator-drier and a primary rectification column, thereby removing catalyst poisons for an oxidation catalyst used for oxidation of carbon monoxide and hydrogen in the feed air by means of the carbon dioxide eliminator-drier and the primary rectification column, condensing and liquefying a part of low purity nitrogen gas separated in the primary rectification column by means of a condenser, warming the raw nitrogen gas which has not been condensed and liquefied in the condenser to normal temperature by means of a heat exchanger and compressing it by a recyclic compressor so that the pressure thereof is increased and the temperature thereof is raised, oxidizing carbon monoxide and hydrogen in an oxidation column and removing the resulting carbon dioxide and water by an adsorption column.

13 Claims, 3 Drawing Sheets

ULTRA-HIGH PURITY NITROGEN GENERATING METHOD

DETAILED DESCRIPTION OF THE INVENTION

1. Technical Field

The present invention relates to an ultra-high purity nitrogen generating method and a generator therefor, and especially to an ultra-high purity nitrogen generating method for generating ultra-high purity nitrogen gas or liquid nitrogen suitable for the manufacture of submicron LSI from feed air by use of rectification columns and a generator therefor.

2. Prior Art

For example, as disclosed in the official gazette of Japanese Patent Application Laid-open No. 225,568/1986, a high purity nitrogen generating method and a generator therefor have been hitherto proposed, which comprise compressing feed air, passing the feed air having a high temperature as a result of this compression through a column packed with an oxidation catalyst, where carbon monoxide (CO) and hydrogen (H2) are oxidized to carbon dioxide (CO2) and water (H20), respectively, and then cooling down the feed air and removing these carbon dioxide and water in an adsorption column packed with an adsorbent, and thereafter further cooling down and liquefying the feed air by means of a heat exchanger, and introducing the liquefied feed air to a rectification column to produce a high purity nitrogen product.

PROBLEMS SOUGHT FOR SOLUTION BY THE INVENTION

In the aforementioned prior art, however, SOX, H2S or the like in feed air act as catalyst poisons to reduce the activity of an oxidation catalyst remarkably, because the feed air is compressed and the compressed feed air is directly introduced to a catalyst column. Accordingly, it is necessary to provide an equipment for removing these matters acting as the catalyst poisons at a front stage of the catalyst, to pack the catalyst more than a required amount, into taking consideration the deterioration of its activity, or to provide an equipment for increasing the reaction temperature.

The present invention is intended to eliminate the aforementioned drawbacks.

MEANS FOR SOLUTION OF THE PROBLEMS

One ultra-high purity nitrogen generating method according to the present invention comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is roughly rectified, thereby further removing the carbon dioxide, moisture and catalyst poisons therefrom;

a third step of warming raw nitrogen gas that is the nitrogen gas obtained by the second step and containing oxygen, and then compressing the warmed raw nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas, and introducing the cooled raw nitrogen gas to an adsorption column, where the carbon dioxide and water in the raw nitrogen gas are removed by adsorption;

a fifth step of cooling down the feed raw nitrogen gas obtained at the fourth step and introducing the cooled feed raw nitrogen gas to a secondary rectification column, where it is rectified, and at the same time, supplying cold necessary for the above-mentioned rectification to anyone of the equipments in a cold box; and a sixth step of taking out an ultra-high purity nitrogen gas product or an ultra-high purity liquefied nitrogen product from the secondary rectification column.

A further ultra-high purity nitrogen generating method according to the present invention comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is roughly rectified, thereby further removing the carbon dioxide, moisture and catalyst poisons therefrom;

a third step of condensing raw nitrogen gas that is the nitrogen gas obtained by the second step and containing oxygen so that a part thereof is liquefied and causing the liquefied nitrogen gas to circulate to the primary rectification column as a reflux liquid, and at the same time, warming the remaining raw nitrogen gas, and then compressing the warmed nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas, and introducing the cooled raw nitrogen gas to an adsorption column, where the carbon dioxide and water in the raw nitrogen gas are removed by adsorption;

a fifth step of cooling down the feed raw nitrogen gas obtained at the fourth step and introducing the cooled feed raw nitrogen gas to a secondary rectification column, where it is rectified;

a sixth step of expanding the liquid nitrogen obtained from the bottom portion of the secondary rectification column at the fifth step, and then introducing the expanded liquid nitrogen to the primary rectification column as a feed material and cold;

a seventh step of condensing the nitrogen gas obtained at the fifth step by means of a reboiler-condenser so as to provide high purity liquid nitrogen, and returning this high purity liquid nitrogen to the secondary rectification column, and exhausting the noncondensing gas which has been not condensed in the reboiler-condenser from the lower portion of the reboiler-condenser;

an eighth step of supplying cold necessary for the above-mentioned rectification to anyone of the equipments in a cold box; and a ninth step of using a part of the high purity liquid nitrogen returned from the reboiler-condenser to the secondary rectification column as a reflux liquid, and taking out the remaining part thereof from a rectifying tray several stages below a rectifying tray in the top portion of the secondary rectification column as an ultra-high purity nitrogen gas product or an ultra-high purity liquid nitrogen product.

Liquid nitrogen from the outside may be supplied to the primary rectification column as cold necessary for the above-mentioned rectification.

A further ultra-high purity nitrogen generating method according to the present invention comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is roughly rectified, thereby further removing the carbon dioxide, moisture and catalyst poisons therefrom;

a third step of condensing raw nitrogen gas that is the nitrogen gas obtained by the second step and containing oxygen so that a part thereof is liquefied and causing the liquefied nitrogen gas to circulate to the primary rectification column as a reflux liquid, and at the same time, warming the remaining raw nitrogen gas, and then compressing the warmed nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas and introducing the cooled raw nitrogen gas to an adsorption column, where the carbon dioxide and water in the raw nitrogen gas are removed by adsorption;

a fifth step of cooling down the feed raw nitrogen gas obtained at the fourth step and introducing the cooled feed raw nitrogen gas to a secondary rectification column, where it is rectified;

a sixth step of expanding the liquid nitrogen obtained from the bottom portion of the secondary rectification column at the fifth step, and then introducing the expanded liquid nitrogen to the primary rectification column as a feed material and cold;

a seventh step of condensing the nitrogen gas obtained in the fifth step by means of a reboiler-condenser so as to provide high purity liquid nitrogen, and returning this high purity liquid nitrogen to the secondary rectification column, and exhausting the noncondensing gas which has been not condensed in the reboiler-condenser from the lower portion of the reboiler-condenser;

an eighth step of expanding the oxygen-rich liquid obtained from the bottom portion of the primary rectification column at the second step, and then evaporating the expanded oxygen-rich liquid through heat exchange so as to provide a waste gas;

a ninth step of heating the waste gas obtained at the eighth step, and then adiabatically expanding the heated waste gas and using the expanded waste gas as cold;

a tenth step of heating the waste gas obtained at the ninth step, and using the heated waste gas in order to regenerate the carbon dioxide eliminator-drier; and an eleventh step of rectifying the high purity liquid nitrogen in the secondary rectification column, and taking out the rectified liquid nitrogen from a rectifying tray several stages below a rectifying tray in the top portion of the secondary rectification column as an ultra-high purity nitrogen gas product or an ultra-high purity liquid nitrogen product.

A further ultra-high purity nitrogen generating method according to the present invention comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is roughly rectified, thereby further removing the carbon dioxide, moisture and catalyst poisons therefrom;

a third step of condensing raw nitrogen gas that is the nitrogen gas obtained by the second step and containing oxygen so that a part thereof is liquefied and causing the liquefied nitrogen gas to circulate to the primary rectification column as a reflux liquid, and at the same time, warming the remaining raw nitrogen gas, and then compressing the warmed nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas and introducing the cooled raw nitrogen gas to an adsorption column, where the carbon dioxide and water in the raw nitrogen gas are removed by adsorption;

a fifth step of cooling down the feed raw nitrogen gas obtained at the fourth step and introducing the cooled feed raw nitrogen gas to a secondary rectification column, where it is rectified, and at the same time, taking out at least a part of the feed raw nitrogen gas, while it is being cooled, and adiabatically expanding the take-out nitrogen gas and using the expanded nitrogen gas as cold;

a sixth step of expanding the liquid nitrogen obtained from the bottom portion of the secondary rectification column at the fifth step, and then introducing the expanded liquid nitrogen to the primary rectification column as a feed material and cold;

a seventh step of introducing the nitrogen gas formed through rectification in the secondary rectification column at the fifth step to a reboiler-condenser and returning high purity liquid nitrogen obtained through condensation therein to the secondary rectification column, and exhausting the noncondensing gas which has been not condensed in the reboiler-condenser from the lower portion of the reboiler-condenser; and an eighth step of taking out an ultra-high purity nitrogen gas product or an ultra-high purity liquid nitrogen product from a rectifying tray several stages below a rectification tray in the top portion of the secondary rectification column.

One ultra-high purity nitrogen generator according to the present invention comprises:

a carbon dioxide eliminator-drier for removing, from feed air, carbon dioxide, moisture and catalyst poisons for an oxidation catalyst contained therein;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a compressor for increasing the pressure of the raw nitrogen gas obtained from the primary rectification column and raising the temperature thereof;

an oxidation column for converting carbon monoxide in the raw nitrogen gas increased in pressure and raised in temperature to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product;

a heat exchanger for exchanging heat among the feed air to be introduced to the primary rectification column, the raw nitrogen gas obtained from the primary rectification column, the feed raw nitrogen gas to be introduced to the secondary rectification column and the ultra-high purity nitrogen gas product with one another;

a cold box surrounding the heat exchanger and the primary and secondary rectification columns; and a means for supplying cold necessary for the above-mentioned rectification to any one of the equipments in the cold box.

A further ultra-high purity nitrogen generator according to the present invention comprises:

a carbon dioxide eliminator-drier for removing, from feed air, carbon dioxide, moisture and catalyst poisons for an oxidation catalyst contained therein;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for converting carbon monoxide in the raw nitrogen gas increased in pressure and raised in temperature to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top portion of the secondary rectification column;

a means involving an expansion valve for expanding the liquid nitrogen obtained from the bottom portion of the secondary rectification column and introducing the expanded liquid nitrogen to the primary rectification column as a feed material and cold;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product with one another;

a cold box surrounding the heat exchanger, the primary and secondary rectification columns, the gas-liquid separator, the nitrogen condenser and the reboiler-condenser; and a means for supplying deep low temperature nitrogen to anyone of the equipments in the cold box as cold necessary for the above-mentioned rectification.

A further ultra-high purity nitrogen generator according to the present invention comprises:

a carbon dioxide eliminator-drier for removing, from feed air, carbon dioxide, moisture and catalyst poisons for an oxidation catalyst contained therein;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for converting carbon monoxide in the raw nitrogen gas increased in pressure and raised in temperature to carbon dioxide and hydrogen also contained therein to water; and an adsorption column for cooling down the carbon dioxide and water formed through oxidation and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top potion of the secondary rectification column;

a means involving an expansion valve for expanding the liquid nitrogen obtained from the bottom portion of the secondary rectification column and introducing the expanded liquid nitrogen to the primary rectification column as a feed material and cold;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product with one another; and a means involving an expansion turbine for adiabatically expanding waste gas obtained from the primary rectification column and introducing the expanded waste gas to the heat exchanger as cold.

A further ultra-high purity nitrogen generator according to the present invention comprises:

a carbon dioxide eliminator-drier for removing, from feed air, a carbon dioxide, moisture and catalyst poisons for an oxidation catalyst contained therein;

a primary rectification column for roughly rectifying the feed air passed through the carbon dioxide eliminator-drier, thereby obtaining raw nitrogen gas that is the nitrogen gas containing oxygen, from which the catalyst poisons for the oxidation catalyst have been further removed;

a gas-liquid separator and a nitrogen condenser for condensing the raw nitrogen gas obtained from the primary rectification column so as to provide liquid nitrogen circulating to the primary rectification column;

a compressor for increasing the pressure of the raw nitrogen gas which has been not liquefied in the nitrogen condenser and raising the temperature thereof;

an oxidation column for oxidizing the raw nitrogen gas increased in pressure and raised in temperature so that carbon monoxide in the raw nitrogen gas is converted to carbon dioxide and hydrogen also contained therein to water; and an adsorption column for cooling down the carbon dioxide and water formed through oxidation, and removing them by adsorption, thereby obtaining feed raw nitrogen gas;

a secondary rectification column for rectifying the feed raw nitrogen gas, thereby obtaining an ultra-high purity nitrogen gas product or an ultra-high purity liquid nitrogen product from a rectifying tray several stages below a rectifying tray in the top portion of the secondary rectification column;

a means involving an expansion valve for expanding the liquid nitrogen obtained from the bottom portion of the secondary rectification column and introducing the expanded liquid nitrogen to the primary rectification column as a feed material and cold;

a reboiler-condenser for condensing and liquefying the nitrogen gas obtained from the top portion of the secondary rectification column, and then causing the liquefied nitrogen gas to circulate to the secondary rectification column;

a heat exchanger for exchanging heat among the feed air to be introduced to the primary rectification column, the raw nitrogen gas which has been not liquefied in the nitrogen condenser, the feed raw nitrogen gas to be introduced to the secondary rectification column and the ultra-high purity nitrogen gas product with one another; and a means involving an expansion turbine for taking out a part of the feed raw nitrogen gas to be introduced to the secondary rectification column from the way of the heat exchanger and adiabatically expanding the taken-out nitrogen gas, and introducing the expanded nitrogen gas to the heat exchanger as cold.

Referring to the accompanying drawings, the embodiments of the present invention will be described.

Figure 1:
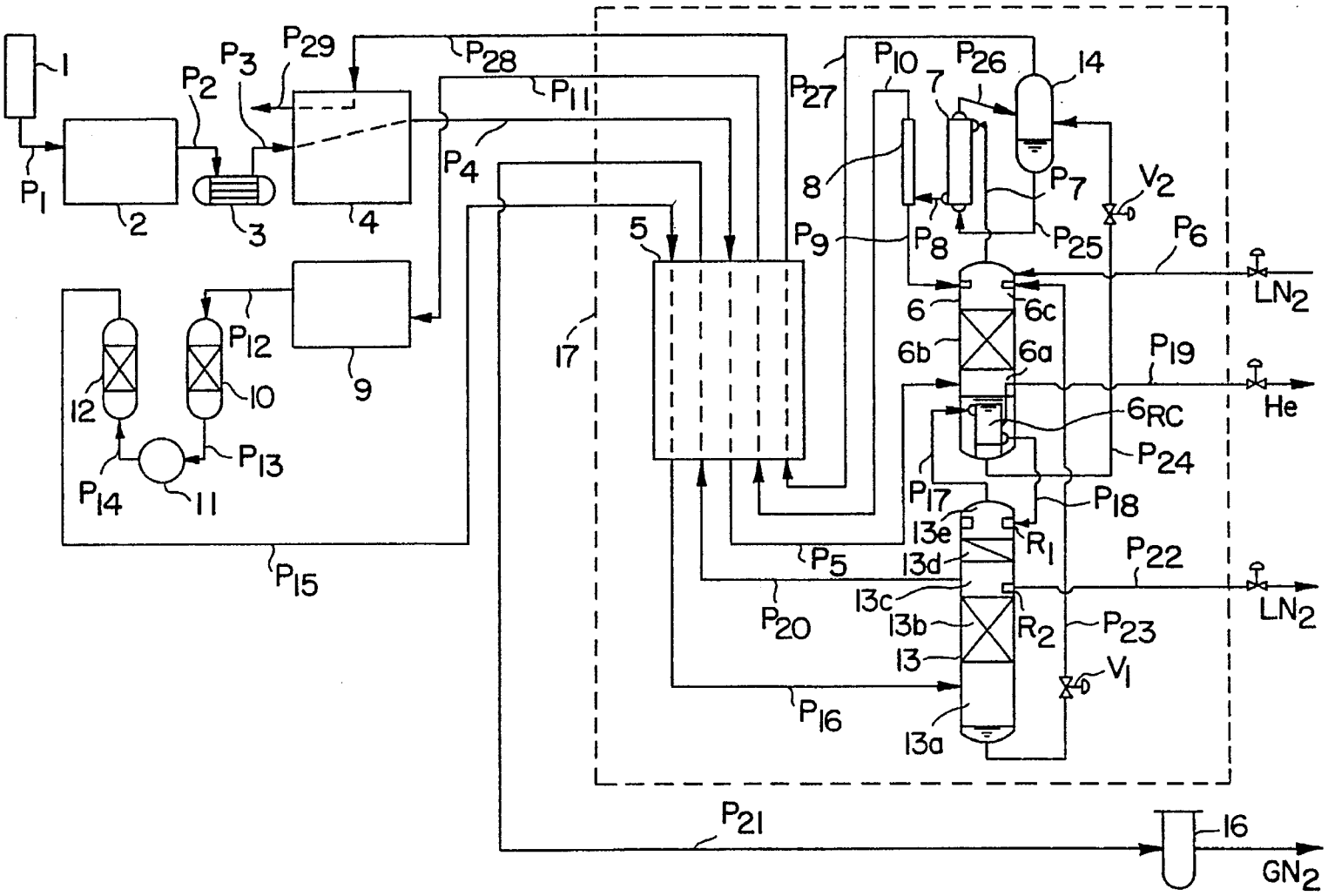
FIGS. 1, 2 and 3 are flow diagrams showing respectively first, second and third preferred embodiments of an ultra-high purity nitrogen generating method and generator therefor according to the present invention.

In the present invention, as shown in a flow diagram of FIG. 1, feed air is introduced at 1,000 Nm 3/h into an air filter 1 to eliminate dust therefrom, the feed air free from dust is introduced to a compressor 2 through a pipe P1 so as to be compressed to a pressure necessary for the separation of air, for instance, to 6 ATA, and then the compressed feed air is passed though a Freon refrigerator 3 by way of a pipe P2 so as to be cooled down, and thereafter the cooled feed air is fed to a carbon dioxide eliminator-drier 4 through a pipe P3.

This carbon dioxide eliminator-drier 4 is composed of two molecular sieve columns which will be alternatively switched for use. The feed air is fed to one of them to remove carbon dioxide (CO2) and moisture (H20) and further sulfides such as SOX and H2S which are catalyst poisons for an oxidation catalyst, by adsorption, while waste gas (impure oxygen gas) which has passed through a main heat exchanger 5, hereinafter mentioned below, is fed to the other molecular sieve column as a regenerating gas for the carbon dioxide eliminator-drier 4.

The feed air, from which carbon dioxide, moisture, sulfides and other impurities have been removed by means of this carbon dioxide eliminator-drier 4, is fed to the main heat exchanger 5 through a pipe P4 so as to be cooled down near to its liquefying point, and then fed to a feed air intake portion *6a* in the lower portion of a primary rectification column 6 through a pipe P5. To the upper portion of this primary rectification column 6, liquid nitrogen that is one example of cold source is fed through a pipe P6, where the feed air ascending from the lower portion in the rectification portion *6b* of the primary rectification column 6 and the liquid nitrogen (a reflux liquid) descending from the upper portion of the primary rectification column 6 are brought in contact with each other in a countercurrent state, thereby liquefying oxygen in the feed air and separating low purity nitrogen gas containing the remaining part of oxygen content by rectification.

The said low purity nitrogen gas (i.e. nitrogen gas containing an oxygen content) taken out of the column top of the primary rectification column 6 is led to a nitrogen condenser 7 through a pipe P7 so as to be liquefied by heat exchange with an oxygen-rich liquid, hereinafter mentioned below, and further it is led to a gas-liquid separator 8 through a pipe P8 so as to be subjected to gas-liquid separation. Liquid nitrogen separated here is returned to the upper portion of the primary rectification column 6 through a pipe P9 as a reflux liquid, and raw nitrogen gas also separated here is fed to the main heat exchanger 5 through a pipe P10 so as to be used as a cold source for the main heat exchanger 5.

The raw nitrogen gas which has been raised to normal temperature by itself as a result, is introduced to a recyclic compressor 9 at a pressure of 5.5 ATA through a pipe P11 so as to be compressed to a pressure of 9 ATA, and the compressed raw nitrogen gas is led to an oxidation column 10 packed with an oxidation catalyst through a pipe P12 to oxidize carbon monoxide (CO) and hydrogen (H2) remaining in the raw nitrogen gas to carbon dioxide and water, and then cooled down at a cooler 11 through a pipe P13. After the cooling, the raw nitrogen gas is led to an adsorption column 12 through a pipe P14, where carbon dioxide and water are removed by adsorption, and then it is led to the main heat exchanger through a pipe P15 as feed raw nitrogen gas so as to be liquefied near to its liquefying point, and fed to a feed raw nitrogen intake portion 13*a* in the lower portion of a secondary rectification column 13.

The feed raw nitrogen gas fed in the feed raw nitrogen intake portion 13*a* is brought in contact with the descending reflux liquid as it is ascending in the rectification portions 13*b*, 13*d* of the secondary rectification column 13. As a result, the oxygen content thereof is liquefied and reservoired in the bottom portion of the secondary rectification column 13, as contained in the liquid nitrogen. The rectified nitrogen gas, from which the oxygen content has been removed, is taken out of the top portion of the secondary rectification column 13, and led to a reboiler-condenser 6RC disposed in the lower portion of the primary rectification column 6 or separately placed outside of the primary rectification column 6 through a pipe P17 so as to be liquefied. The obtained liquid nitrogen is returned to a reservoir R1 in the upper portion 13*e* of the secondary rectification column 13 through a pipe P18, and the impurities not liquefied such as helium He, hydrogen H2, neon Ne are discharged out of the lower portion of the reboiler-condenser 6RC through a pipe P19.

The said liquid nitrogen returned to the reservoir R1 of the secondary rectification column 13 is high purity nitrogen which scarcely contains higher boiling point components and lower boiling point components than that of nitrogen. In order to further decrease the low boiling point components, the liquid nitrogen is caused to flow down in a rectification portion 13*d* lower than the reservoir R1 which is composed of several rectifying trays. Thus, an ultra-high purity nitrogen gas product is taken out of a product take-out portion 13*c* through a pipe P20, led to the main heat exchanger 5 so as be warmed to normal temperature, and passed through a pipe P21 having a particle filter (dust filter) 16 inserted on its way to remove fine dust, and then taken out under about 8 ATA at about 400 Nm3/h as a product gas, and an ultra-high purity liquid nitrogen product is taken out of a reservoir R2 of the secondary rectification column 13 as liquid.

The liquid nitrogen in the bottom portion of the secondary rectification column 13, in which the oxygen content has been enriched, is passed through a pipe P23 so as to be expanded to 5.5 ATA by means of an expansion valve V1 inserted in the pipe P23, and the expanded liquid nitrogen is then fed to the upper portion 6C of the primary rectification column 6 as cold and feed nitrogen so as to be used as a reflux liquid and feed nitrogen to the primary rectification column 6.

The oxygen-rich liquid in the bottom portion of the primary rectification column 6 is passed through a pipe P24 from the bottom portion of the primary rectification column 6 so as to be expanded by means of an expansion valve V2 inserted in the pipe P24, and then fed to a gas-liquid separator 14. A liquid separated in the gas-liquid separator 14 is led from the bottom portion of the gas-liquid separator 14 to the said nitrogen condenser 7 through a pipe P25. In the nitrogen condenser 7, the separated oxygen-rich liquid acts as a cold source so as to be gasified by itself, and the thus-formed oxygen-rich gas is returned to the gas-liquid separator 14 through a pipe P26, where it is led together with the gas formed by gas-liquid separation to the main heat exchanger 5 through a pipe P27 and used as a cold source in the main heat exchanger 5 so that cold is recovered. The gas warmed to normal temperature by this heat exchange is led to the other molecular sieve column of the said carbon dioxide eliminator-drier 4 through a pipe P28 so as to be used as a regenerating gas for the carbon dioxide eliminator-drier 4, and then discharged through a pipe P29 as a waste gas.

Figure 2:
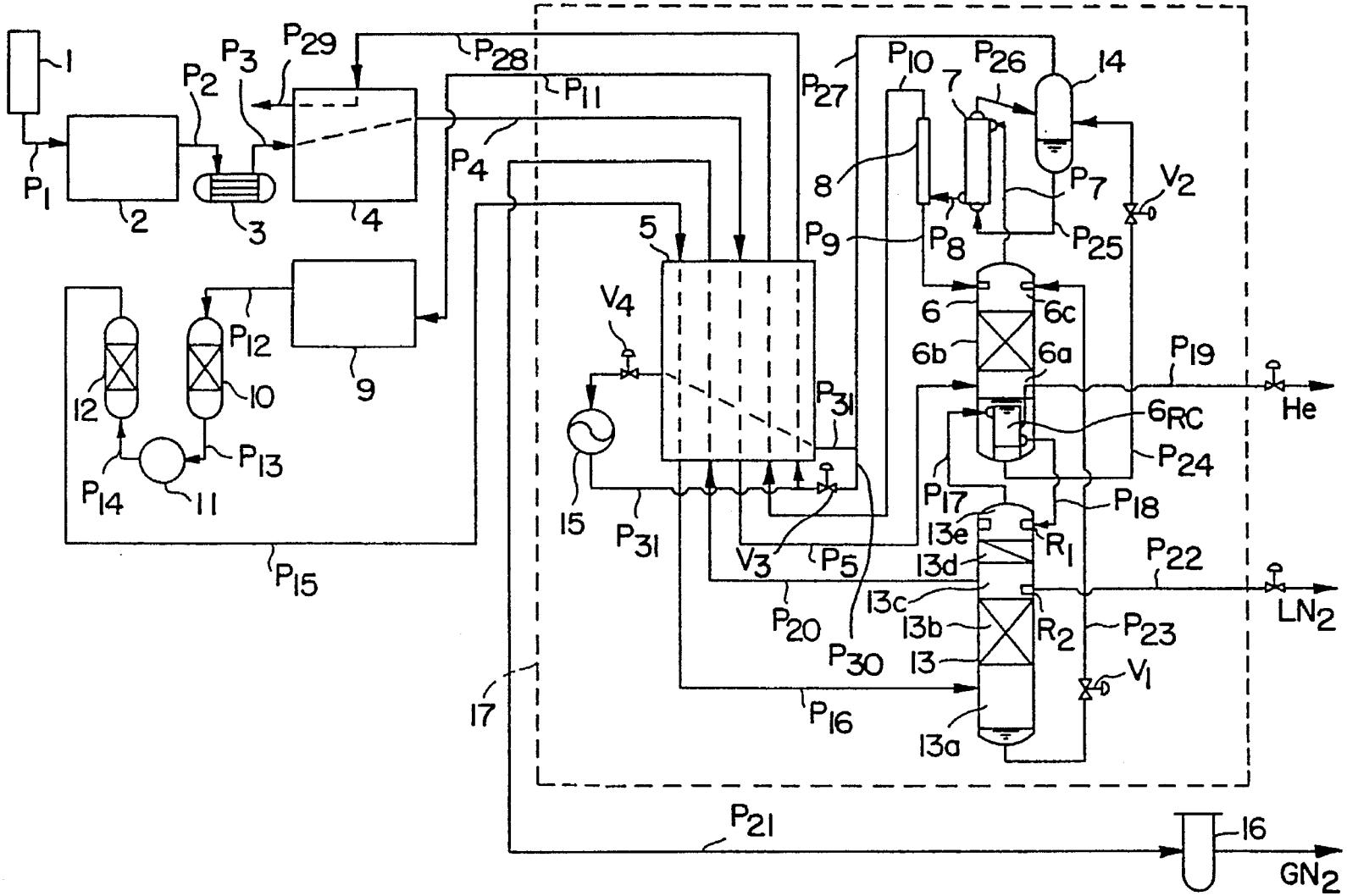
Figure 3:
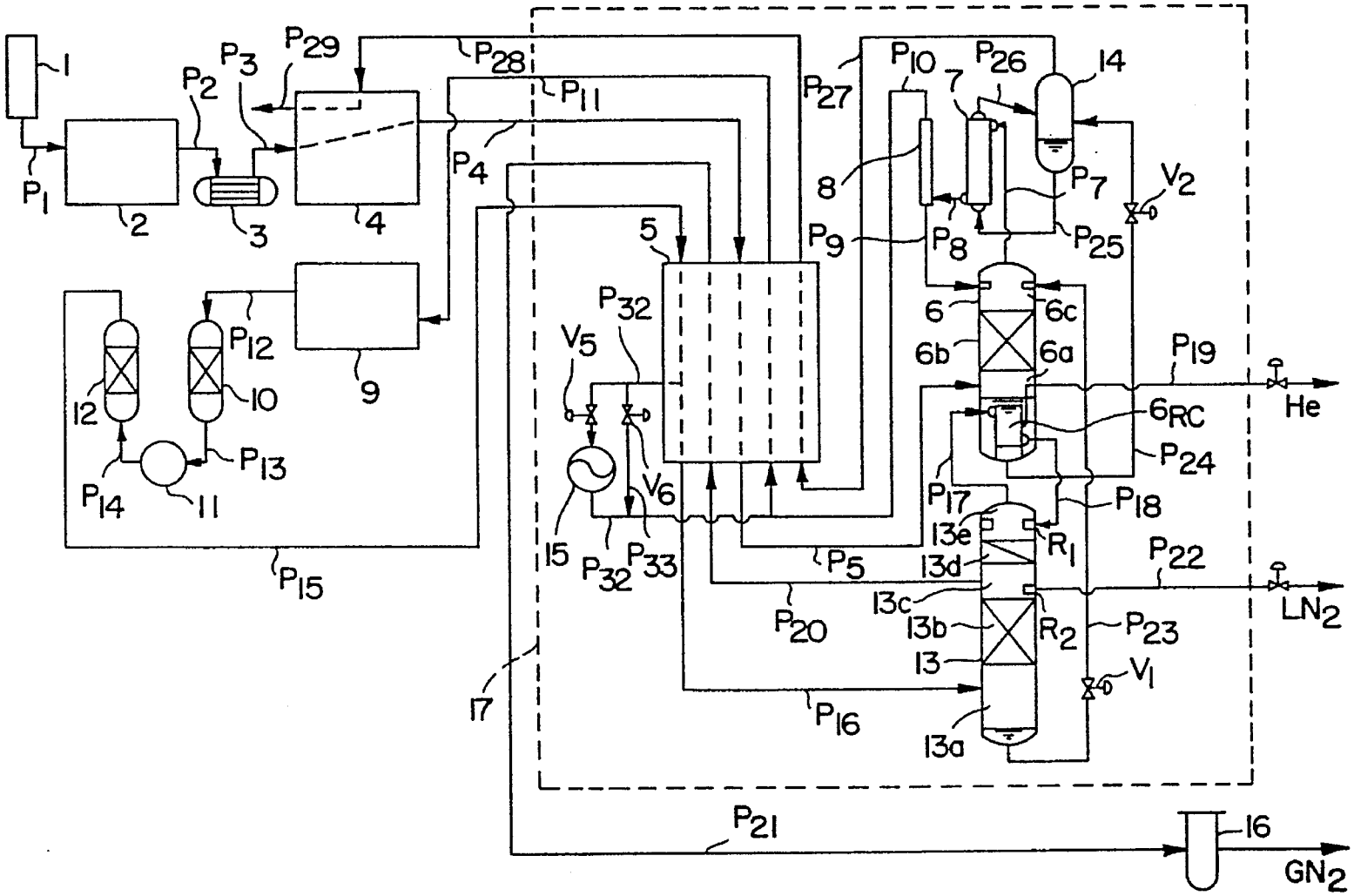

In addition, a part 17 surrounded by a dotted line in FIG. 1 is a cold box, wherein the equipments such as the main heat exchanger 5, primary rectification column 6, reboiler-condenser 6RC, nitrogen condenser 7, gas-liquid separator 8, secondary rectification column 13, gas-liquid separator 14, expansion valves V1, V2 and pipes thereof are accommodated. This cold box 17 is thermally insulated from the atmosphere because of a low temperature portion. In order to supply the shortage of cold, liquid nitrogen in an amount as large as about 1% of the feed air fed to the compressor 2 through the pipe P1 is fed into the primary rectification column 6 from the outside by way of a pipe P6. In the cases of FIG. 2 and FIG. 3 showing the other embodiments mentioned below, the shortage of cold will be generated for use by an expansion turbine 15.

FIG. 2 shows the second embodiment of the present invention. In the first embodiment shown in FIG. 1, by the way, the waste gas (oxygen-rich gas) taken out of the top portion of the said gas-liquid separator 14 through the pipe P27 is directly added into the main heat exchanger 5. However, in the second embodiment shown in FIG. 2, the passage for the said waste gas is divided to two branch paths before it enters the main heat exchanger 5, and a pipe P30 that is one branch path has a shut-off valve V3 inserted therein and a pipe P31 that is the other branch path extends in the main heat exchanger 5 from its low temperature side to the way between the low temperature and high temperature sides and this pipe P31 has a shut-off valve V4 and an expansion turbine 15 inserted outside of the main heat exchanger 5, wherein cold generated by the expansion turbine 15 is joined to the pipe P30 so as to be used as a cold source for the main heat exchanger 5.

In this second embodiment, the open degree of the shut-off valves V3, V4 will be regulated, without carrying out the supply of cold from the outside, thereby regulating the flow rate of the gas passing through the expansion turbine 15 so that the quantity of cold is increased or decreased so as to correspond to the liquid quantity or gas quantity to be taken out as the product. Accordingly, the operation of the whole generator unit can be stabilized.

FIG. 3 shows the third embodiment of the present invention. In the first embodiment shown in FIG. 1, by the way, the feed raw nitrogen gas, from which carbon dioxide and moisture have been removed by adsorption, is introduced to the main heat exchanger 5 through the pipe P16. However, in this third embodiment shown in FIG. 3, a part of the feed raw nitrogen gas is taken out of the way of the main heat exchanger 5 between its low temperature and high temperature sides through the pipe P32, and joined with the raw nitrogen gas for recyclic use taken out of the top portion of the gas-liquid separator 8 through the pipe P10, and the joined flow of nitrogen gas is introduced to the main heat exchanger 5.

The said pipe P32 has a shut-off valve V5 and an expansion turbine 15 inserted in series therein, and a pipe P33 is connected in parallel with both the ends of the shut-off valve V5 and expansion turbine 15 connected in series and this said pipe P33 has a shut-off valve V6 inserted therein. The degree of opening of the shut-off valves V5, V6 will be regulated, thereby regulating the flow rate of the gas passing through the expansion turbine 15 so that the quantity of cold generated by the expansion turbine 15 is increased or decreased. Thus, this cold can be used as a cold source necessary for the operation of the generator unit.

In the ultra-high purity nitrogen generating method and generator therefor according to the present invention, there are obtained such large merits that the activity of the catalyst can be maintained semi-permanently because the feed gas is passed through the catalyst column after catalyst poisons such as SOX and H2S are removed therefrom by normal temperature purification and low temperature liquefaction and rectification, and further the ultra-high purity nitrogen can be recovered at a high yield because the low purity nitrogen separated by low temperature liquefaction and rectification is recycled.

We claim:

1. An ultra-high purity nitrogen generating method, which comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is partly rectified, thereby further removing the carbon dioxide, moisture and catalyst poisons therefrom, to generate raw nitrogen gas that is removed from said primary rectification column;

a third step of warming said raw nitrogen gas containing oxygen, and then compressing the warmed raw nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas, and introducing the cooled raw nitrogen gas to an adsorption column, where the carbon dioxide and water in the raw nitrogen gas are removed by adsorption;

a fifth step of cooling down the feed raw nitrogen gas obtained at the fourth step and introducing the cooled feed raw nitrogen gas to a secondary rectification column, where it is rectified; and a sixth step of taking out an ultra-high purity nitrogen gas product or an ultra-high purity liquefied nitrogen product from the secondary rectification column.

2. An ultra-high purity nitrogen generating method, which comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is partly rectified, thereby further removing the carbon dioxide, moisture and catalyst poisons therefrom;

a third step of condensing raw nitrogen gas that is the nitrogen gas obtained by the second step and containing oxygen so that a part thereof is liquefied and causing the liquefied nitrogen gas to circulate to the primary rectification column as a reflux liquid, and at the same time, warming the remaining raw nitrogen gas, and then compressing the warmed nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas, and introducing the cooled raw nitrogen gas to an adsorption column, where the carbon dioxide and water in the raw nitrogen gas are removed by adsorption;

a fifth step of cooling down the feed raw nitrogen gas obtained at the fourth step and introducing the cooled feed raw nitrogen gas to a secondary rectification column, where it is rectified;

a sixth step of expanding the liquid nitrogen obtained from the bottom portion of the secondary rectification column at the fifth step, and then introducing the expanded liquid nitrogen to the primary rectification column as a feed material and cold source; and a seventh step of supplying a cold source to said primary rectification column.

3. Method as claimed in claim 2, which comprises:

supplying liquid nitrogen from the outside to the primary rectification column.

4. Method as claimed in claim 2, further comprising condensing the nitrogen gas obtained at the fifth step by means of a reboiler-condenser so as to provide high purity liquid nitrogen, and returning this high purity liquid nitrogen to the secondary rectification column, and exhausting the noncondensing gas which has been not condensed in the reboiler-condenser from the lower portion of the reboiler-condenser.

5. Method according to claim 2, further comprising a part of the high purity liquid nitrogen returned from the reboiler-condenser to the secondary rectification column as a reflux liquid, and taking out the remaining part thereof from a rectifying tray several stages below a rectifying tray in the top portion of the secondary rectification column as an ultra-high purity nitrogen gas product or an ultra-high purity liquid nitrogen product.

6. An ultra-high purity nitrogen generating method, which comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is partly rectified, thereby further removing the carbon dioxide, moisture and catalyst poisons therefrom;

a third step of condensing raw nitrogen gas that is the nitrogen gas obtained by the second step and containing oxygen so that a part thereof is liquefied and causing the liquefied nitrogen gas to circulate to the primary rectification column as a reflux liquid, and at the same time, warming the remaining raw nitrogen gas, and then compressing the warmed nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas and introducing the cooled raw nitrogen gas to an adsorption column, where the carbon dioxide and water in the raw nitrogen gas are removed by adsorption;

a fifth step of cooling down the feed raw nitrogen gas obtained at the fourth step and introducing the cooled feed raw nitrogen gas to a secondary rectification column, where it is rectified;

a sixth step of expanding oxygen-rich liquid obtained from the bottom portion of the primary rectification column at the second step, and then evaporating the expanded oxygen-rich liquid through heat exchange so as to provide a waste gas;

a seventh step of heating the waste gas obtained at the sixth step, and then adiabatically expanding the heated waste gas and using the expanded waste gas as a cold source; and an eighth step of heating the waste gas obtained at the seventh step, and using the heated waste gas in order to regenerate the carbon dioxide eliminator-drier.

7. Method according to claim 6, further comprising expanding the liquid nitrogen obtained from the bottom portion of the secondary rectification column at the fifth step, and then introducing the expanded liquid nitrogen to the primary rectification column as a feed material and cold source.

8. Method according to claim 6, further comprising condensing the nitrogen gas obtained at the fifth step by means of a reboiler-condenser so as to provide high purity liquid nitrogen, and returning this high purity liquid nitrogen to the secondary rectification column, and exhausting the noncondensing gas which has been not condensed in the reboiler-condenser from the lower portion of the reboiler-condenser.

9. Method according to claim 6, further comprising rectifying the high purity liquid nitrogen in the secondary rectification column, and taking out the rectified liquid nitrogen from a rectifying tray several stages below a rectifying tray in the top portion of the secondary rectification column as an ultra-high purity nitrogen gas product or an ultra-high purity liquid nitrogen product.

10. An ultra-high purity nitrogen generating method, which comprises:

a first step of removing, from feed air, carbon dioxide, moisture and catalyst poisons for an oxidation catalyst contained therein by means of a carbon dioxide eliminator-drier;

a second step of cooling down the feed air obtained by the first step and introducing the cooled feed air to a primary rectification column, where it is partly rectified, thereby further removing the carbon dioxide, moisture and catalyst poisons therefrom;

a third step of condensing raw nitrogen gas that is the nitrogen gas obtained by the second step and containing oxygen so that a part thereof is liquefied and causing the liquefied nitrogen gas to circulate to the primary rectification column as a reflux liquid, and at the same time, warming the remaining raw nitrogen gas, and then compressing the warmed nitrogen gas so that it is increased in pressure and raised in temperature;

a fourth step of introducing the raw nitrogen gas obtained by the third step to an oxidation column, where carbon monoxide in the raw nitrogen gas is converted to carbon dioxide and hydrogen also contained therein to water, and then cooling down the raw nitrogen gas and introducing the cooled raw nitrogen gas to an adsorption column, where the carbon dioxide and water in the raw nitrogen gas are removed by adsorption; and a fifth step of cooling down the feed raw nitrogen gas obtained at the fourth step and introducing the cooled feed raw nitrogen gas to a secondary rectification column, where it is rectified, and at the same time, taking out at least a part of the feed raw nitrogen gas, while it is being cooled, and adiabatically expanding the take-out nitrogen gas and using the expanded nitrogen gas as a cold source.

11. Method according to claim 10, further comprising expanding the liquid nitrogen obtained from the bottom portion of the secondary rectification column at the fifth step, and then introducing the expanded liquid nitrogen to the primary rectification column as a feed material and cold source.

12. Method according to claim 10, further comprising introducing the nitrogen gas formed through rectification in the secondary rectification column at the fifth step to a reboiler-condenser and returning high purity liquid nitrogen obtained through condensation therein to the secondary rectification column, and exhausting the noncondensing gas which has been not condensed in the reboiler-condenser from the lower portion of the reboiler-condenser.

13. Method according to claim 10, further comprising taking out an ultra-high purity nitrogen gas product or an ultra-high purity liquid nitrogen product from a rectifying tray several stages below a rectification tray in the top portion of the secondary rectification column.

* * * * *